United States Patent [19]

Barber

[11] 3,991,997

[45] Nov. 16, 1976

[54] PAPER FEED MECHANISM FOR OFFSET PRINTER

[76] Inventor: Walter W. Barber, 31830 Trevor Ave., Hayward, Calif. 94544

[22] Filed: Jan. 2, 1976

[21] Appl. No.: 646,132

Related U.S. Application Data

[63] Continuation of Ser. No. 537,618, Dec. 30, 1974, abandoned, which is a continuation of Ser. No. 409,491, Oct. 25, 1973, abandoned, which is a continuation of Ser. No. 241,636, April 6, 1972, abandoned.

[52] U.S. Cl. ..... 271/108; 214/8.5 D; 251/309

[51] Int. Cl.[2] ..... B65H 3/08

[58] Field of Search ..... 271/108, 90, 96, 30 R, 271/98, 103, 106, 107; 251/309; 214/8.5 D

[56] References Cited

UNITED STATES PATENTS

| | | | |
|---|---|---|---|
| 1,575,892 | 3/1926 | Ashby | 271/108 X |
| 2,085,592 | 6/1937 | Koppe | 271/103 X |
| 2,840,415 | 6/1958 | Morris | 271/90 UX |
| 2,937,868 | 5/1960 | Didde et al. | 271/30 R |
| 2,986,392 | 5/1961 | Buttner | 271/90 |
| 3,220,694 | 11/1965 | Eschbaugh | 251/309 X |

FOREIGN PATENTS OR APPLICATIONS

| | | | |
|---|---|---|---|
| 465,570 | 9/1928 | Germany | 271/108 |

*Primary Examiner*—John J. Love
*Assistant Examiner*—Bruce H. Stoner, Jr.
*Attorney, Agent, or Firm*—Townsend and Townsend

[57] ABSTRACT

An improved paper feed mechanism includes a vacuum manifold having a number of spaced, paper feeding suction tubes with each tube having a valve intermediate its ends. The valves permit respective tubes to be selectively placed in fluid communication with the manifold.

2 Claims, 5 Drawing Figures

FIG. 1
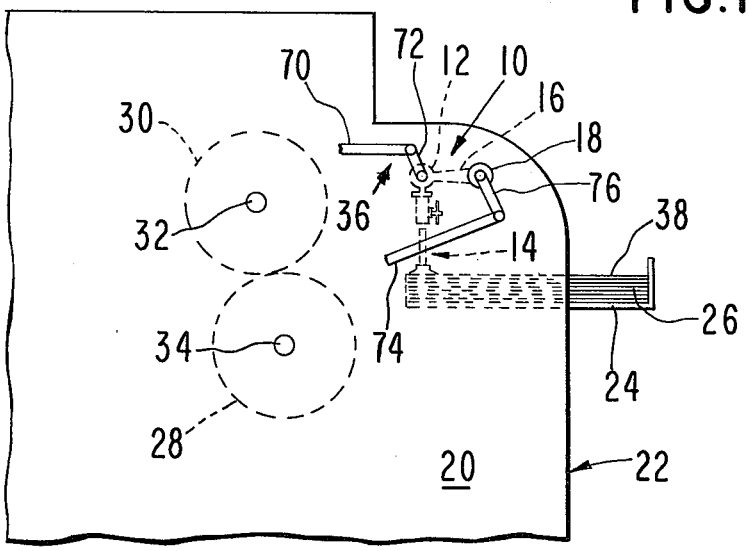
FIG. 2
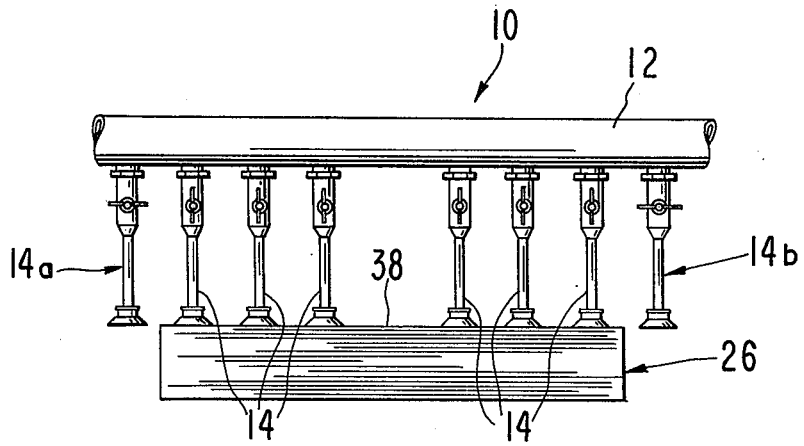
FIG. 3
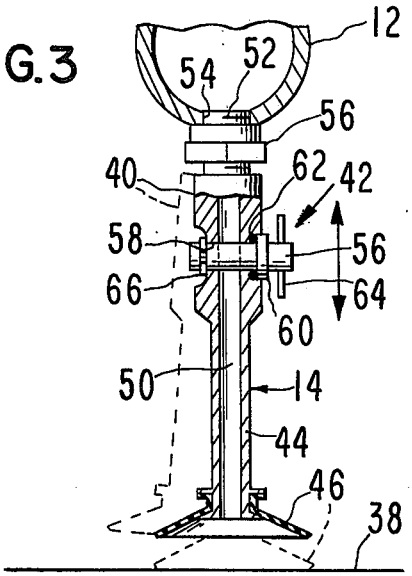
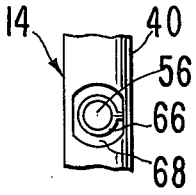
FIG. 5
FIG. 4
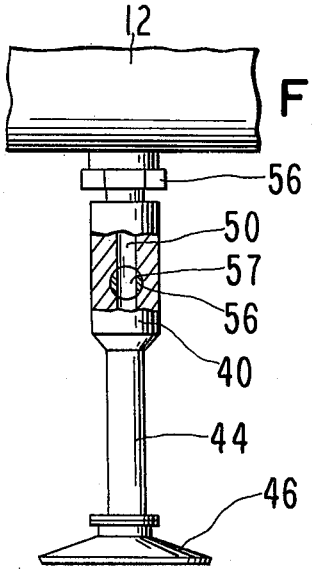

PAPER FEED MECHANISM FOR OFFSET PRINTER

This is a continuation of application Ser. No. 537,618 filed Dec. 30, 1974, now abandoned, the latter application being a continuation of application Ser. No. 409,491 filed Oct. 25, 1973, now abandoned the latter being a continuation of application Ser. No. 241,636 filed April 6, 1972, now abandoned.

This invention relates to improvements in paper feed techniques for offset printing machines and, more particularly, to a paper feed mechanism having selectively operable, paper feeding suction tubes.

In an offset printer, paper sheets are fed one at a time from a stack toward and between the impression and blanket cylinders of the printer. The feed mechanism comprises a shiftable vacuum manifold provided with a plurality of spaced suction tubes secured to and depending from the manifold, so that the upper sheet of the stack can be drawn to and adhere to the lower ends of the tubes by suction when the tubes are lowered by the manifold. As the manifold raises, the tubes elevate the upper sheet from the stack. Then, the manifold is rotated to swing the tubes into inclined, forwardly extending positions. At the same time, suction is removed from the tubes and the paper sheet is projected forwardly and away from the tubes and between the blanket and impression cylinders of the printer. The tubes and manifold repeat these steps many times per minute so that the paper sheets are fed quickly and readily from the stack.

Conventional suction tubes are threaded into holes formed in and spaced along the length of the manifold. Sometimes all of the tubes are not needed because the width of the paper sheets to be fed is less than the effective length of the manifold. When this situation arises, certain tubes must be removed from the manifold and the holes therein must be capped. Otherwise, the suction tubes which are not needed would extend to the side of the sheet stack and would draw air into the manifold during the suction phase, thereby rendering the other tubes ineffective. To remove the suction tubes and to cap the manifold holes requires time and effort. The printer must be shut down and this causes productivity to suffer.

The present invention is directed to an improved paper feed mechanism which avoids the above-mentioned problem by providing a vacuum manifold having a plurality of suction tubes with each suction tube having a valve on it so that the tubes can be selectively actuated or deactuated immediately without having to remove the tubes from the manifold. Thus, when it is desired to eliminate certain tubes, such as when the width of the paper sheets to be fed is less than the length of the manifold, it is only a simple matter to close the valves of those tubes which are not needed, leaving the other tubes operable, i.e., in fluid communication with the manifold. This can be done in a very short time, thereby keeping machine shutdown time to a minimum so as to affect productivity very little.

The invention, therefore, provides a paper feed mechanism which is capable of handling paper sheets of various widths. Moreover, the suction tubes of this invention can be placed on manifolds of existing paper feed mechanisms without modifying the latter.

The primary objection of this invention is to provide an improved paper feed mechanism for an offset printer wherein the suction tubes on the vacuum manifold of the mechanism have individual valves thereon which can be opened or closed to change the number of operable tubes on the manifold without removing the suction tubes therefrom.

Another object of this invention is to provide an improved suction tube for a paper feed mechanism of an offset printer wherein the suction tube has a valve intermediate its ends to selectively block the fluid passage therethrough, whereby the suction tube can be permanently mounted on the vacuum manifold of the feed mechanism and can change the paper feeding capacity thereof so as to minimize the time and expense required to remove conventional suction tubes from the manifold and to the holes thereof.

Other objects of this invention will become apparent as the following specification progresses, reference being had to the accompanying drawing for an illustration of an embodiment of the invention.

IN THE DRAWING:

FIG. 1 is a partial, side elevational view of an offset printer with which the improved feed mechanism of this invention is utilized;

FIG. 2 is an enlarged, rear elevational view of a portion of the feed mechanism, showing the improved suction tubes thereon;

FIG. 3 is an enlarged, cross-sectional view of a suction tube and manifold showing the valve thereof in an open position;

FIG. 4 is a rear elevational view of the suction tube partly broken away and in section; and FIG. 5 is an enlarged, fragmentary, front elevational view of the suction tube.

The paper feed mechanism which is the subject of this invention is broadly denoted by the numeral 10 and includes a vacuum manifold 12 and a plurality of suction tubes 14 connected to and in fluid communication with the manifold and depending therefrom. The manifold is connected by a pair of spaced arms 16 (only one of which is shown in FIG. 1) to a rotatable shaft 18 spanning the distance between a pair of sides 20 of an offset printer 22 shown only fragmentarily in FIG. 1. A typical offset printer on which feed mechanism 10 is usable is one manufactured and sold by A. B. Dick Company, 5700 West Touhy Avenue, Chicago, Ill., especially Models 369, 380, 382 and 385 thereof.

Manifold 12 and shaft 18 are mounted above a platform 24 for supporting a stack 26 of paper sheets to be fed one-by-one from the upper end of the stach toward and between an impression cylinder 28 and a blanket cylinder 30 for printing the sheet. The cylinders are mounted on respective shafts 32 and 34 which span the distance between and are rotatably mounted on sides 20. Means (not shown) coupled with the cylinders rotate the same at predetermined speeds and in opposite directions with respect to each other. The machine is also provided with lever means 36, hereinafter described, which is coupled with manifold 12 and shaft 18 to cause the manifold to move in a specific manner when the upper sheet 38 of stack 26 is to be removed from the stack and advanced toward and between cylinders 28 and 30.

Each suction tube 14 has an upper cylindrical segment 40 provided with a valve 42 thereon and a lower cylinder segment integral with segment 40 and being of a smaller diameter than the latter. Tube 14 is formed of a suitable, rigid material, such as metal or plastic. A flexible suction cup 46 is removably mounted on the lower end of segment 44 and flares outwardly and downwardly from the lower, open end 48 of tube 14. The suction cup is adapted to engage the upper sheet 38 and to cause the latter to adhere by suction thereto when the fluid passage 50 of tube 14 is at a reduced air pressure, i.e., when manifold 12 is coupled to a source of vacuum.

The upper end of segment 40 has a tubular, threaded extension 52 which is to be threadably mounted within a hole 54 in the bottom of manifold 12. A lock nut 56 threadably carried on extension 52 is adapted to bear against the bottom of manifold 12 to lock tube 14 in place.

Valve 42 includes a cylindrical valve member 56 which is rotatably mounted within a transverse bore 58 formed in segment 40 above the upper end of segment 44. Valve member 56 has a hole 57 therethrough for communication with passage 50 and has an annular flange 60 adjacent to one end thereof for bearing against an 0-ring seal 62 which is received within a countersunk region at the corresponding end of bore 58. A handle 64 on valve member 56 near flange 60 permits manual rotation of the valve member.

The opposite end of the valve member has slot (not shown) for rotatably receiving a C-shaped retainer clip 66 whereby the valve member is held in bore 58 but is rotatable relative thereto. Clip 66 has a flat inner face in engagement with a flat surface 68 of a countersunk portion on the side of segment 40 opposite to the side adjacent to 0-ring 62. Clip 66 forms a fluid-tight seal with surface 68.

A plurality of suction tubes 14, mounted at spaced locations on manifold 12, are aligned with the front margin of the uppermost sheet 38 of stack 26 as shown in FIG. 1. FIG. 2 illustrates the way in which the outermost tubes on the manifold can be deactivated when the width of the sheet to be fed requires less than all of the tubes. For instance, the outer tubes 14*a* and 14*b* of sheet assembly 10 are rendered inoperative by closing the valves thereof, to the closed positions being indicated by the horizontal positions of handles 64. The other suction tubes remain operative because their valves are open as indicated by the vertical positions of corresponding handles 64.

Lever means 36 for moving manifold 12 is conventional in construction and is only shown fragementarily in FIG. 1, since it is believed unnecessary to detail this structure. It includes a first lever 70 pivotally mounted to the outer end of an arm 72 rigidly secured to and extending laterally from one end of manifold 12. A second lever 74 is pivotally mounted to the outer end of an arm 76 which is rigidly coupled to one end of shaft 18. Lever means 36 operates to move lever 74 to pivot shaft 18 in a counter-clockwise sense when viewing FIG. 1 to cause manifold 12 to be lowered until suction cups 46 of tubes 14 engage upper sheet 38. During this time, manifold 12 is coupled by valve structure (not shown) to the vacuum source. Thus, upper sheet is caused to adhere by suction to the suction cups. Then, the rotation of shaft 18 is reversed by moving lever 74 in the opposite direction until tubes 14 are elevated to lift sheet 38 from stock 26. Then, lever 70 is moved to the right to cause clockwise rotation of manifold 12, whereby tubes 14 are pivoted toward cylinders 28 and 30. At this time, suction is removed from the manifold, thereby permitting release of the sheet. Its momentum carries it forwardly and between cylinders 28 and 30.

FIG. 3 illustrates in dashed lines the various positions of the suction tubes during the aforesaid movements of manifold 12. The movement of the manifold is done at a relatively high speed and the suction is alternately applied to and removed from the manifold for each cycle of movement thereof.

In operation, tubes 14 are coupled with manifold 12 and, depending upon the width of the stack 26, the valves are actuated or deactuated, such as shown in FIG. 2. Once the feed mechanism is actuated, levers 70 and 74 operate to pivot manifold 12 and shaft 18 in the manner described above so that the suction tubes can be lowered first into the lower dashed line position of FIG. 3 to allow the suction cups 46 to engage the upper sheet 38, following which the suction tubes are lifted into the full line position of FIG. 3, and then are pivoted into the left-hand dashed line position of FIG. 3. At the latter position, suction is removed from the manifold and thereby tubes 14 to allow sheet 38 to be released. The sheet continues forwardly by its momentum and is received between cylinders 28 and 30. The movements of levers 70 and 74 are reversed to return the suction tubes along the same path so that they can repeat the foregoing process for the next uppermost sheet.

Tubes 14 can be used to replace conventional suction tubes. Generally, manifold 12 has threaded holes 54 even for the conventional tubes. Thus, it is a simple matter to remove the conventional tubes and to replace them with tubes 14.

Valve 56 on each tube 14 permits the suction force at inlet end 48 of the tube to be varied. Thus, for relatively lightweight paper, the suction force can be made relatively low by turning the valve member to a partially closed position. For relatively heavy paper, the valve can be turned to a more fully opened position. This will assure that lightweight paper will not be sucked upwardly and creased or otherwise deformed by excessive suction force.

The inside diameter of passage 50 is made large relative to that of conventional suction tubes for offset printers. For instance, such inside diameter for tube 14 is preferably about 0.125 inches; whereas, for conventional tubes the corresponding dimension is approximately 0.093 inches. This allows card stock to be readily handled by feed mechanism 10 with the present invention, but handled only with difficulty with conventional tubes.

I claim:

1. In an offset printing machine having means for supporting a stack of sheets, a paper feed mechanism comprising: a manifold adapted to be coupled to a source of vacuum and to be mounted on the machine in a generally horizontal position for movement with respect to the stack; and a plurality of spaced, rigid, open end tubes for communicating with the manifold at spaced locations along the same and for extending downwardly therefrom, each tube having a first, longitudinal bore therethrough and a second bore transverse to and communicating with the first bore, a cylindrical valve member extending through the second bore and being rotatable relative to the tube, the valve member having a flange adjacent to one end thereof, and an O-ring seal between the flange and the tubes and surrounding one end of the second bore, a retainer clip removably coupled to the opposite end of the valve member and operable to hold the flange against the seal and to permit rotation of the valve member relative to the tube, the normally upper end of each tube being externally threaded, and a lock nut threaded on the upper end of each tube, respectively, and engageable with the manifold for adjusting the spacing between the manifold and the lower end of the tube independently of the other tubes, the lower end of each tube having a resilient suction cup thereon, the suction cups of the tubes being movable into proximity with the uppermost sheet of the stack as the manifold moves in one direction related thereto and when the paper feed mechanism is mounted on the machine, whereby the uppermost sheet can adhere by suction to the suction cups and be removed from the stack as the manifold moves away therefrom.

2. In an offset printer having means for supporting a stack of sheets and a paper feed mechanism provided with a generally horizontal manifold coupled to a source of vacuum and movable with respect to the stack, sheet pick-up means comprising: a tube for communicating with the manifold at a predetermined location thereon with the tube extending downwardly therefrom, said tube having a first, longitudinal bore therethrough and a second bore transverse to and communicating with the first bore, a cylindrical valve member extending through the second bore and being rotatable relative to the tube to control fluid flow through the first bore, the valve member having a flange adjacent to one end thereof, and an O-ring seal between the flange and the tubes and surrounding one end of the second bore, a retainer clip removably coupled to the opposite end of the valve member and operable to hold the flange against the seal and to permit rotation of the valve member relative to the tube, the normally upper end of the tube being externally threaded and movable into threaded engagement with the manifold, and a lock nut threaded on the upper end of the tube and engageable with the manifold when the tube is threadably engaged therewith for adjusting the spacing between the manifold and the lower end of the tube, the lower end of the tube having a resilient suction cup movable into proximity with the uppermost sheet of the stack as the manifold moves in one direction related thereto and when the tube is threadably engaged therewith, whereby the uppermost sheet can adhere by suction to the suction cup and be removed from the stack as the manifold moves away therefrom.

* * * * *